US011896171B2

(12) United States Patent
Gallob et al.

(10) Patent No.: US 11,896,171 B2
(45) Date of Patent: Feb. 13, 2024

(54) INTEGRATED FAUCET AND DRYER WITH RECIRCULATING FLOW

(71) Applicant: Stone and Steel Systems, LLC, Scottsdale, AZ (US)

(72) Inventors: Randall Gallob, Scottsdale, AZ (US); Charles S. Allen, Franklin Park, IL (US); Jason Mak, Franklin Park, IL (US)

(73) Assignee: Stone And Steel Systems, LLC, Mesa, AZ (US)

( * ) Notice: Subject to any disclaimer, the term of this patent is extended or adjusted under 35 U.S.C. 154(b) by 562 days.

(21) Appl. No.: 17/251,562

(22) PCT Filed: Jun. 11, 2019

(86) PCT No.: PCT/US2019/036579

§ 371 (c)(1),
(2) Date: Dec. 11, 2020

(87) PCT Pub. No.: WO2019/241270

PCT Pub. Date: Dec. 19, 2019

(65) Prior Publication Data

US 2021/0321835 A1 Oct. 21, 2021

Related U.S. Application Data

(60) Provisional application No. 62/683,570, filed on Jun. 11, 2018.

(51) Int. Cl.
*A47K 10/48* (2006.01)
*E03C 1/186* (2019.01)

(52) U.S. Cl.
CPC ..... *A47K 10/48* (2013.01); *E03C 1/186* (2013.01)

(58) Field of Classification Search
CPC ..... A57K 10/48; E03C 1/186
(Continued)

(56) References Cited

U.S. PATENT DOCUMENTS 4,398,310 A 8/1983 Lienhard
6,959,460 B2 * 11/2005 Patterson ..... A47K 1/02 4/625

(Continued)

FOREIGN PATENT DOCUMENTS

BR 102017019533 A2 5/2018
CA 2873015 A1 * 9/2013 ..... A47K 10/48

(Continued)

OTHER PUBLICATIONS

Dec. 16, 2022—(CA) 2nd Office Action—App 3,103,609.

(Continued)

*Primary Examiner* — Stephen M Gravini
(74) *Attorney, Agent, or Firm* — Banner & Witcoff, Ltd.

(57) ABSTRACT

One embodiment relates to a sink system having an air recirculating mechanism for exhausted hand dryer air. The sink system includes a sink deck having a sink opening and an outer shell. The sink deck being separated from a sink basin region of a sink basin by a vent ring. A sink basin defines a sink basin region and a plenum region. The plenum region is separated from the sink basin region by the vent ring. A plenum cavity is formed between an internal surface of the outer shall and the plenum region. The vent ring includes a vent with an associated opening. The opening is exposed to the sink basin region and to an area underneath the sink deck, the opening allowing a flow of air there-through. A dryer is configured to direct forced air through a dryer exhaust port into the sink basin region of the sink basin.

20 Claims, 10 Drawing Sheets

(58) Field of Classification Search
USPC ..... 34/523
See application file for complete search history.

(56) References Cited

U.S. PATENT DOCUMENTS

| | | | | |
|---|---|---|---|---|
| 7,971,368 | B2 * | 7/2011 | Fukaya | A47K 10/48 222/1 |
| 8,136,262 | B2 * | 3/2012 | Collins | A47K 10/48 340/657 |
| 9,441,885 | B2 * | 9/2016 | Bayley | F26B 21/12 |
| 9,758,953 | B2 * | 9/2017 | Bayley | A61L 9/16 |
| 9,877,620 | B2 * | 1/2018 | Gallob | E03C 1/0404 |
| 10,455,992 | B2 * | 10/2019 | Satermo | A47K 10/48 |
| 10,694,906 | B2 * | 6/2020 | Courtney | A47K 10/48 |
| 10,786,124 | B2 * | 9/2020 | Fujimura | A47K 10/48 |
| 11,197,585 | B1 * | 12/2021 | Podemska-Mikluch | A47K 1/04 |
| 2011/0155934 | A1 * | 6/2011 | Guler | E03D 3/06 251/129.04 |
| 2011/0277342 | A1 * | 11/2011 | Ishii | A47K 10/48 34/526 |
| 2013/0025045 | A1 * | 1/2013 | Gagnon | A47K 1/04 4/654 |
| 2014/0070444 | A1 * | 3/2014 | Matthews | B29C 48/911 264/105 |
| 2014/0259735 | A1 | 9/2014 | Muderlak et al. | |
| 2015/0074899 | A1 | 3/2015 | Gallob | |
| 2015/0376881 | A1 | 12/2015 | Moe | |
| 2021/0321835 | A1 * | 10/2021 | Gallob | E03C 1/186 |

FOREIGN PATENT DOCUMENTS

| | | | | |
|---|---|---|---|---|
| DE | 4239868 | C1 | 3/1994 | |
| EP | 2399496 | A1 * | 12/2011 | A47K 10/48 |
| EP | 2828440 | B1 * | 6/2018 | A47K 10/48 |
| JP | 5100885 | B2 * | 12/2012 | A47K 10/48 |
| WO | 2019241270 | A1 | 12/2019 | |

OTHER PUBLICATIONS

Nov. 16, 2022—(CN) 2nd Office Action—App 201980048704.7.
Aug. 26, 2019—(WO) International Search Report and Written Opinion—App PCT/US2019/036579.
Mar. 21, 2023—(CN) 3rd Office Action—App 201980048704.7.
Sep. 30, 2021—(IN) First Examination Report—App 202047054886.
Feb. 28, 2022—(CA) Office Action—App 3,103,609.
Feb. 16, 2022—(CN) 1st Office Action—App 201980048704.7.

* cited by examiner

INTEGRATED FAUCET AND DRYER WITH RECIRCULATING FLOW

CROSS-REFERENCE TO RELATED APPLICATIONS

This application is a U.S. National Stage application under 35 U.S.C. § 371 of International Application PCT/US2019/036579, filed Jun. 11, 2019, which claims the benefit of priority to U.S. Provisional Application No. 62/683,570, filed Jun. 11, 2018, and the present application claims the benefit of the filing date of both of these prior applications, which are incorporated by reference in their entireties.

TECHNICAL FIELD

The present disclosure relates generally to methods for a sink system having a faucet and hand dryer, more specifically where the hand dryer directs air to be recirculated within the sink system.

BACKGROUND

Applicant has previously described in U.S. Prov. App. No. 61/785,110 Faucet Dryer, hereby incorporated by reference, an automatic faucet housing with a hand dryer outlet coming out of the faucet spout. Such a device may be positioned above a sink basin such that the water and the air would be dispensed at different moments into the basin. In addition, prior installations of fixtures have included an automatic faucet for dispensing water into a basin with an automatic dryer in proximity also dispensing into a basin. One of the difficulties with such an installation is that if the separate automatic dryer (or the combination as described in the above reference application) is pointed into a sink basin and activated, forced air stream from the automatic hand dryer causes a high pressure region within the sink basin and the air stream can deflect out of the sink basin.

The same issue can arise in situations where a special basin is provided to "catch" water from a user when they are positioned to dry their hands; i.e. the automatic hand dryer is above a separate basin than the basin for the excess water off the hands. With this arrangement a high pressure air stream deflected out of a basin can cause several adverse effects. The high velocity air coming out of the faucet nozzle pointed into the sink (such as in U.S. application Ser. No. 61/785,110) basin can be deflected off the sink basin at an angle out towards the user causing inconvenience. Also, when a sink basin becomes filled with water then the water drains out of the sink, some residual water remains along the surface of the sink basin, or similarly, slow draining sinks can leave residual water present when a drying cycle occurs. When high velocity air coming out of the faucet nozzle pointed into the sink basin deflects off of the sink basin surface, the surface water that has remained on the sink basin surface can be blown out of the sink basin towards the user causing inconvenience. High velocity air traveling at an angle over the residual water in a sink basin has no direction to flow except back out of the sink basin towards the user. Further, this high velocity air is typically directed into the basin, which is often parabolic or hemispherical along a vector that will result in the air deflecting back out of the basin with sufficient energy to cause discomfort to a user. In some types of devices, this redirected air carries with it water that causes user inconvenience, splashing up at the user.

Recent integrated commercial grade sink troughs have multiple fittings consisting of electronic faucets, electronic soap dispensers, and integral hand dryers that use warm forced air to expel moisture off of washed and rinsed hands. All of these hand washing steps are accomplished within an often large sink trough.

Previous patent art, U.S. Pat. No. 9,877,620 by inventor Gallob, teaches forced air through sink deck vents within an integrated plumbing fixture and also allowing forced air through a hand dryer exhaust port into the sink basin. The hand dryer exhaust is positioned relative to the basin region and the vent such that substantially all of the forced air from the dryer is directed through the dryer exhaust port into the sink basin region and then into the vent to exit the sink through a novel air catching lip along the rim of the sink.

Efforts to integrate hand dryer function have recently been seen to have excessive over blowing contributing to undesirable air blow back from the hand dryer outlet deflecting upon the user. In this instance the air deflecting off the user's hands and sink bottom basin may return out of the basin rather than all air flow completely going through the rim vent.

SUMMARY

One embodiment relates to a sink system having an air recirculating mechanism for exhausted hand dryer air. The sink system includes a sink deck having a sink opening and an outer shell. The sink deck being separated from a sink basin region of a sink basin by a vent ring. A sink basin defines a sink basin region and a plenum region. The plenum region is separated from the sink basin region by the vent ring. A plenum cavity is formed between an internal surface of the outer shall and the plenum region. The vent ring includes a vent with an associated opening. The opening is exposed to the sink basin region and to an area underneath the sink deck, the opening allowing a flow of air therethrough. A dryer is configured to direct forced air through a dryer exhaust port into the sink basin region of the sink basin. The dryer is positioned relative to the basin region and the vent such that the forced air from the dryer is directed through the dryer exhaust port into the sink basin region and then into vent.

In another embodiment, a drying system is described. The drying system includes an outer shell defining a sink deck. A sink basin is disposed within the outer shell. The sink basin defines a sink basin region and a plenum region. The plenum region is separated from the sink basin region by a vent ring. The sink deck is separated from the sink basin region of the sink basin by the vent ring. A plenum cavity is formed between an internal surface of the outer shell and the plenum region. The vent ring includes a vent with an associated opening. The opening is exposed to the sink basin region and to an area underneath the sink deck. The opening allows a flow of air therethrough. A dryer is configured to direct forced air through a dryer exhaust port into the sink basin region of the sink basin. The dryer is positioned relative to the basin region and the vent such that the forced air from the dryer is directed through the dryer exhaust port into the sink basin region and then into vent.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

The foregoing and other objects, aspects, features, and advantages of the disclosure will become more apparent and better understood by referring to the following description taken in conjunction with the accompanying drawings, in which.

Figure 1A:
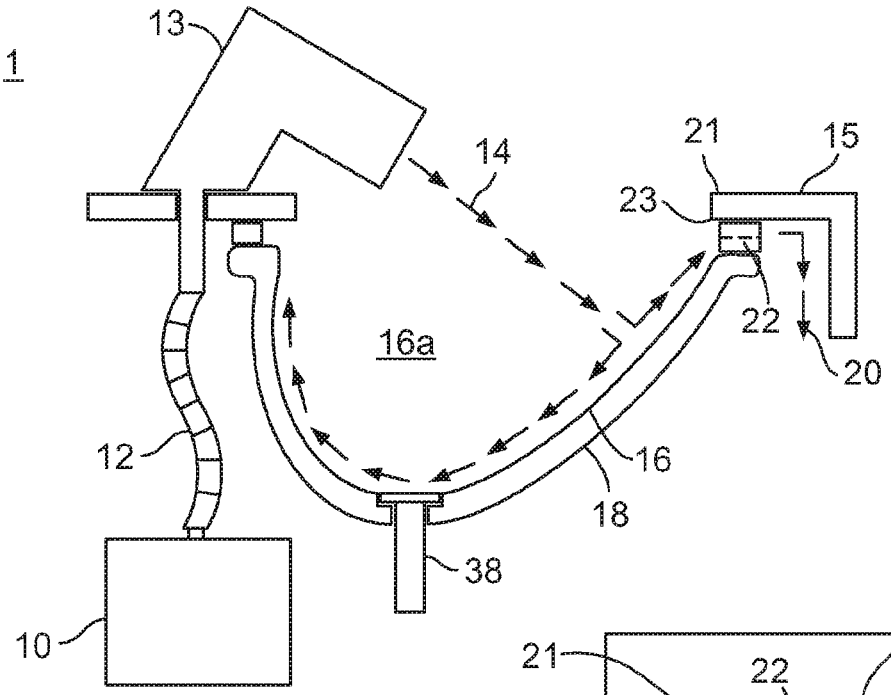
Prior Art FIG. 1A
FIG. 1A shows a cross-sectional view of an under mount sink system, according to an example embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION OF VARIOUS EMBODIMENTS

In the following detailed description, reference is made to the accompanying drawings, which form a part hereof In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure. FIGS. 1A-4B are described in U.S. Pat. No. 9,877,620, which is incorporated herein by reference.

One implementation comprises a sink system 1. The sink system 1 may include a vanity or other "deck" such as the sink deck 15. One implementation of the sink system 1 comprises a dryer spout 13. Further, an automatic faucet 30 may be provided, as well as a drain 38. The dryer spout 13 provides forced air and the automatic faucet 30 provides water. In one embodiment, the dryer spout 13 and automatic faucet 30 may be provided separately from a fixture housing (not shown) or may be integrated within a single component, such as within the fixture housing 40. A housing 40 forming a dryer-faucet is further described in U.S. patent application Ser. No. 14/208,347 incorporated herein by reference.

In one embodiment, the fixture housing 40 having an inlet 42 and an outlet 43 with a passage defined there between. The fixture housing 40 of various form factors as are known in the art. In one implementation the fixture housing 40 is positioned extending above the sink deck 15 with the inlet 42 open to an area below the sink deck 15 and the water outlet 43 positioned above the sink basin 16 such that water is dispensed into the basin region 16*a*.

Figure 4A:
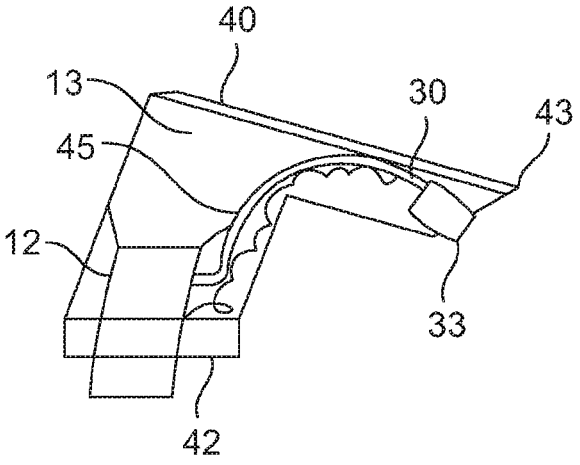
Prior Art FIG. 4A
FIG. 4A is a cross-sectional view of the faucet-dryer of the sink system of FIG. 3.
Figure 4B:
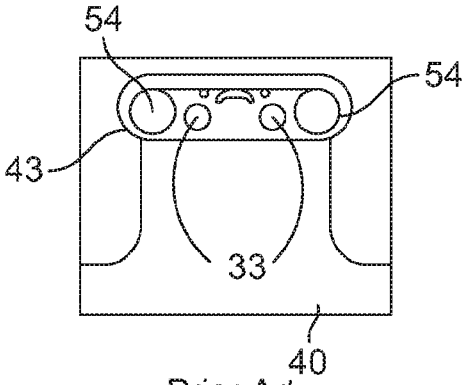
Prior Art FIG. 4B
FIG. 4B is front view of the outlet of the faucet-dryer of FIG. 4A.

A water line (not shown) extends to the faucet 30 to provide water to the faucet. In one implementation, as shown in FIG. 4A, the water line 45 enters the fixture housing 40 at the inlet 42. The fixture housing 40 includes a nozzle(s) 33 which serves as the exit point from the fixture housing 40 for the water, dispensing the water into the basin region 16*a*.

Figure 3:
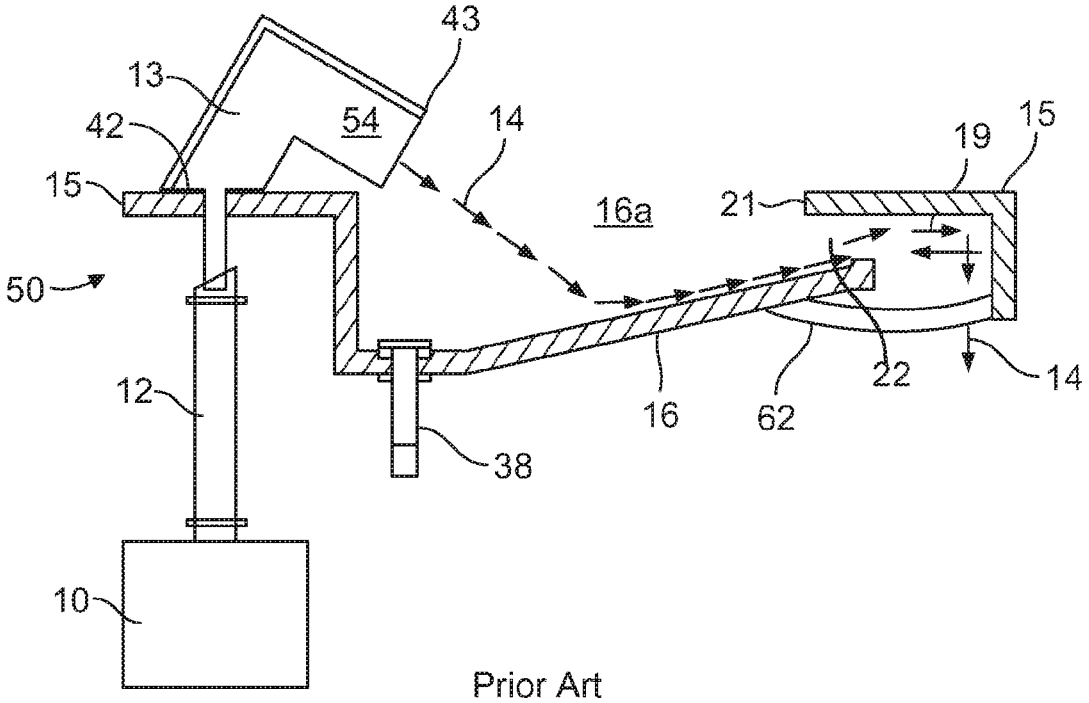
Prior Art FIG. 3
FIG. 3 shows a cross-sectional view of a sink system that includes a basin with a vent ring molded into the fixture as a cast or as a separate mounting ring, according to another example embodiment.

As shown in FIG. 3, the forced air system 50, comprises dryer spout 13, a blower motor 10 and a forced air line 12, such as a duct or plenum. The blower motor 10 provides forced air directed to the dryer spout 13 by the forced air line 12. The dryer spout 13 includes an exhaust housing 54 from which the forced air exits the dryer spout 13.

As described above, the use of a dryer spout 13 directed to a basin 16 to allow for blowing off of water from a user (such as their hands) as the dryer spout 13 blows air stream results in inconvenience caused by a forced air stream 14 pointing into a sink basin 16. This forced air stream 14 is typically deflected towards a user due to the shape of the sink basin 16 and typical location of the fittings on the rear of the basin. With respect to FIG. 1A, by introducing a basin vent 22, for example a vent lip 21 and/or a vent ring 19, along all or a part of the edge of the sink basin 16, a forced air stream 14 blowing into a sink basin 16 can be deflected out of the sink basin region 16*a* and below the sink deck 15, away from the user rather than deflected upwards into a user. In one implementation, the basin vent 22 introduces a fixed surface area all along the top of the sink basin 16 where forced air stream 14, for example high velocity and/or heated air, is redirected away from a user, such as a passageway to escape the sink basin 16 and not be deflected back out at the user.

In one implementation, the vent lip 21 has flow through passages and a small catching edge 23 and with the vents 22 allows the high velocity air 14 to be diverted out of the sink basin 16. In one implementation, the vent lip 21 is cast as part of the sink basin 16. In an alternative implementation, the vent lip 21 is a separate component engageable with the sink deck 15. The vent lip 21 has a circumference (though it need not be circular nor have the exact shape of the basin 16) that is slightly less than the sink basin 16. Thus, the sink basin 16 terminates "under" the sink deck 15 such that there is an area, the vent lip 21, of the sink deck 15 that is exposed about the inner perimeter of the basin 16. This vent lip 21 protrudes into the basin 16 provide a protruding edge 23. In one implementation, the vent lip 21 protrudes sufficiently to prevent the forced air stream 14 from escaping the basin 16, for example ½ inch past the vents 22. In essence, it is believed that the lip 21 acts as an air dam to stop the air stream 14 as well as water from escaping the basin 16 upwards, such as towards a user or above the deck 15. Rather, in certain implementations the air stream 14 is deflected back towards the basin 16 by the vent lip 21.

Figure 1B:
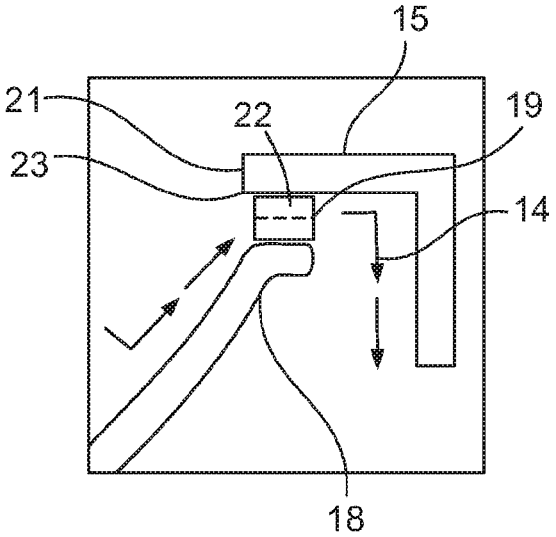
Prior Art FIG. 1B
FIG. 1B shows a cross-sectional view of a vent ring in position between a sink deck and sink basin in a portion of the under mount sink of FIG. 1A.

In one implementation, a vent ring 19 is utilized to allow the high velocity air 14 to be diverted from the sink basin 16 away from the user. The vent ring 19 may be similar to the vent ring 19 shown in FIG. 1C. The vent ring 19 can, in one implementation, be an integral part of the sink basin 16. In an alternative implementation, the vent ring 19 is an integral part of the sink deck 15. Further, in implementation where the vent ring 19 is a separate component, the vent ring 19 may be removably affixed to one of the sink basin 16 or the sink deck 15 and permanently affixed to the other. In a further implementation, the vent ring 19 is a separate component allowing for a "retrofit" of an existing installation. In this embodiment, the separate piece of the vent ring 19 is assembled in between the sink deck 15 and the basin 16 (for example, a "under mount sink"). The vent ring 19 may have substantially the shape of the sink basin 16, the vent ring 19 may be elliptical. Further, in certain embodiments the vent ring 19 is not elliptical but rather includes a first end and a second end and does not extend around the entire sink basin, for example as shown in FIG. 2A-B. In one embodiment, as shown in FIG. 1B, the vent ring 19 includes a plurality of openings 11 formed between supports 9. The openings 11 form, in conjunction with either the sink basin 16 or the sink deck 15, the vents 22. In one embodiment, the openings 11 are located in a portion of the vent ring 19, for example in a 120 degree arc portion, as the forced air is only directed to this area of the sink system 1. In an alternative embodiment, the openings 11 are disposed about the entire vent ring 19.

In one embodiment, no vent ring 19 is utilized, rather the vent 22 is formed by a gap between the lip 21 and the sink basin 16, as shown in FIG. 3. A trap may be utilized to provide a trap or filter in the vent 22.

In a preferred embodiment, the forced air 14, or substantially all that continues to move with sufficient velocity, is directed into the vent 22.

Figure 1C:
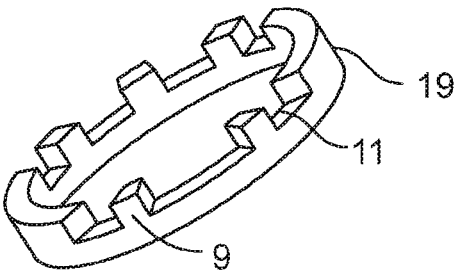
Prior Art FIG. 1C
FIG. 1C shows a perspective view of the vent ring of FIG. 1B.
Figure 2A:
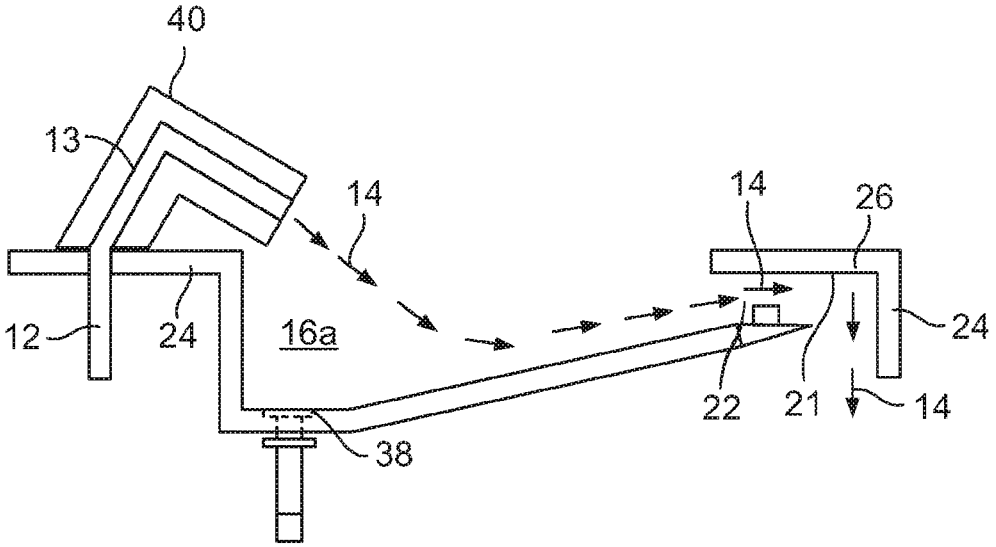
Prior Art FIG. 2A
FIG. 2A shows a cross-sectional view of a solid surface integrated sink system showing a molded or fabricated vent ridge along the front of an integrated sink system, according to an example embodiment.
Figure 2B:
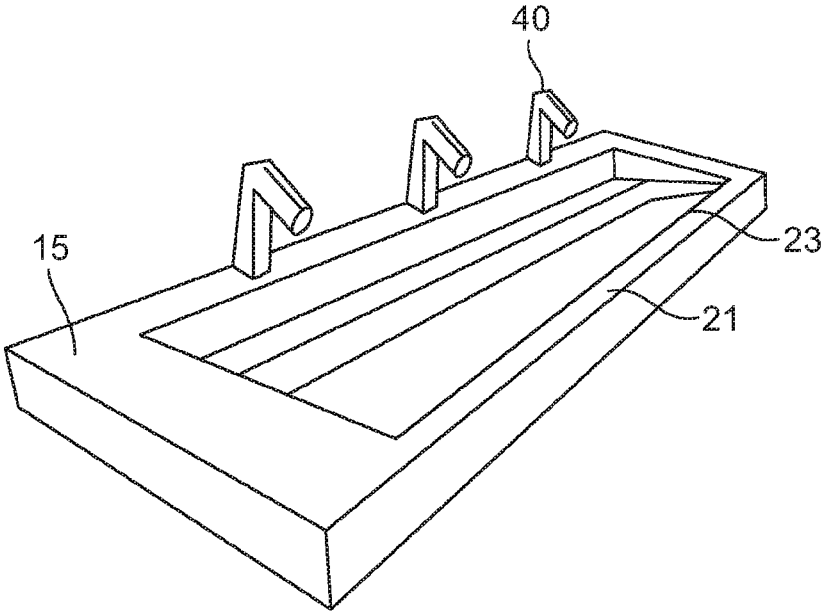
Prior Art FIG. 2B
FIG. 2B shows a perspective view of the integrated sink system of FIG. 2A.

In one implementation, along the circumference of the vent ring 19 are one or more openings 11 to the outside of the sink basin 16 (for example, exposing the area under the sink deck 15 outside of the basin 16), as shown in FIG. 1C. In a further implementation, the vent lip 21 has an edge 23 that redirects the high velocity air and divert out of the sink basin 16. The one or more openings 11 may be spaced about the vent ring 19 (for example, evenly disbursed about the vent ring 19). Further, the one or more openings 11 may be an opening such as a hole or passage in the ring 19 or may be an entire void within the ring 19 (essentially breaking the continuity of the ring 19, such that the ring 19 comprises more than one physical component) or result from the absence of the ring 19 and be formed between the sink deck 15 and the sink basin 16.

In one embodiment, a user uses the automatic faucet/dryer 13 (e.g., an integral dryer) by washing their hands underneath the outlet exhaust 54 of a dryer 13, which, in one embodiment is mounted to an undermounted sink 18 (e.g., FIG. 1A) having the sink basin 16 or a sink deck 15. Inside the outlet 43 of the fixture housing 40 is the exhaust 54 for the dryer 13, exhausting forced air 14 which comes from the blower 10 through a forced air line 12 out through the faucet/dryer exhaust 54. It should be appreciated the forced air 14 may be exhausted from a separate dryer 13 or a dryer 13 included together with a faucet 30 within the fixture housing 40. At the end of the washing sequence, water flow stops and high velocity air 14 blows out of the exhaust 54 onto a user's wet hands blowing off the water while the hands are still within the sink basin 16. This is much the same routine a user follows when they place their hands under a commercial hand dryer in a public restroom which is mounted along a wall away from the washing sink basin 16, causing water to be blown to the floor. The forced air stream 14 blows down along the bottom contour of the sink basin 16 and gets redirected upward deflecting off the lip 21 and the air flows out beyond the vent 22 so as to not inconvenience the user with air (or water) blowing up towards their frontal position.

This diversion of high velocity air and water which otherwise would deflect up towards the standing user is redirected to a lower pressure region by virtue of the vent ring 19. As the high velocity drying air blows over the hands, some of the air hits areas at the bottom of the sink basin 16. As shown in FIG. 1A, the undermount sink 18 is mounted to the underside of the sink deck 15 and the circular vent ring 19 is interposed in between the sink 18 and the sink deck 1. Along the edges of the circular vent ring 19 are openings 11 which can be of various configurations. The circular vent ring 19 is mounted such that a lip 21 is formed on the underside of the sink deck 15. For example, the circumference of the opening in the sink deck 15 for the basin 16 is less than the circumference for the vent ring 19, with the overhanging or extending portion corresponding to the lip 21.

In an alternate embodiment, best shown in FIG. 2A the circular vent ring can be linear vent lip 21 all along the inside front of a typical commercial integrated sink 24. In this application the vent lip 21 also forms the edge 23 on the lip inside of the sink basin 16. In similar fashion an undermount lavatory sink, a user uses the automatic faucet/dryer 13 by washing their hands underneath the outlet nozzle which is mounted to an integrated sink deck 24. Inside the outlet nozzle is an exhaust port for the high velocity hand drying air which comes through a forced air line 12 out through the faucet/dryer fitting exhaust 54. At the end of the washing sequence with no water flow, high velocity air 14 blows out of the outlet nozzle onto a user's wet hands and blows off the water while the hands are still within the sink basin 16 and detection zone. On some integrated sink 24 the high velocity hand dryer air deflects off the bottom of the sink basin 16 and off the lip 21 and out towards the outside of the sink basin 16 as shown in FIG. 2A.

In a similar method, the high velocity hand dryer air 14 is redirected to a lower pressure zone and does not inconvenience user with deflected high velocity hand dryer air 14 up towards the user.

In yet another implementation, the actual lip 21 and ring 19 is cast into a sink basin 16, for example, as shown in the cross-sectional view of FIG. 3. For example, the openings 11 of the vent ring 19 can be molded within vitreous china forming the sink basin 16 so that the high velocity air flow 14 channels itself out of the sink basin 16. Thus, in certain implementations the ring 19 is a unitary portion of the sink basin 16.

In an alternative embodiment the vent ring 19 can be located along the front edge of a longitudinal sink deck 15, solid surface integrated sink system In this embodiment with a sink deck 15 the vent lip 21 can be molded into a front lip of the sink deck assembly. With this embodiment, when the forced air stream 14 blows into the sink deck 15, the molded in vent lip 21 will allow the air to escape out of the sink area and not back up towards the user. The molded intermittent holes 22 in the vent ring 19 open to the outside of the sink deck 15 area allowing the forced air stream 14 to escape the sink area.

In one embodiment, a basin vent may be utilized without an associated faucet or soap dispenser 6. For example, in one embodiment a basin 16 includes a high velocity blower 10 producing the air stream 14 but no associated faucet. Such a faucet-less basin may be utilized alone or in combination with the basin's 16 having a faucet associated therewith. In a particular embodiment, this faucet-less basin is positioned closer to the edge of the deck 15, such as for ease of reach for a user in front of a sink.

The sink systems described above in FIGS. 1A-4B can contain considerable air leakage, by design, through the sink vents that exhaust below the sink to the atmosphere. Due to the distance a normal hand dryer mounted onto sink has to blow to reach the sink vents, considerable dissipation can be expected as the pressure zone around the air flow—coming off the drying hands of the user—deteriorates. This leaves minimal excess energy in which the air flow has to travel through the vent and out the bottom of the sink. In other words, the sinks systems of FIGS. 1A-4B may implement an inefficient air flow path.

Turning to FIGS. 5-11B, a sink system 100 with an air recirculation system is shown, according to an example embodiment. The sink system 100 is similar to the sink system 1, but with critical improvements. A difference between the sink system 100 and the sink system 1 is the sink system 100 includes an air recirculation system 102. Accordingly, like numbering is used to designate like parts between the sink system 100 and the sink system 1.

Figure 5:
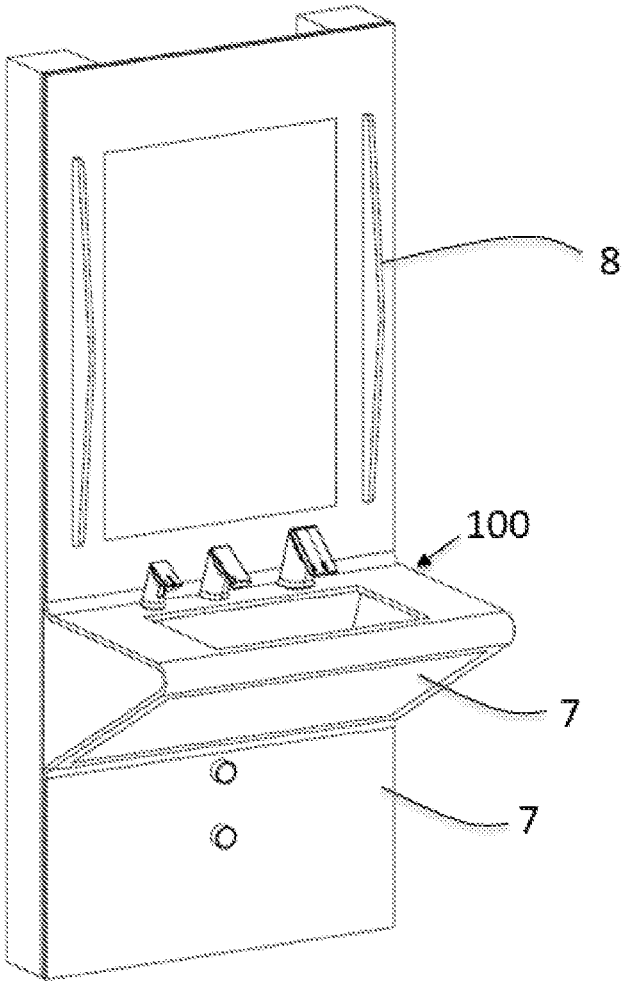
FIG. 5 shows a perspective view of a sink system having a recirculating air system with a mirror and lighting system, according to an example embodiment.
Figure 6:
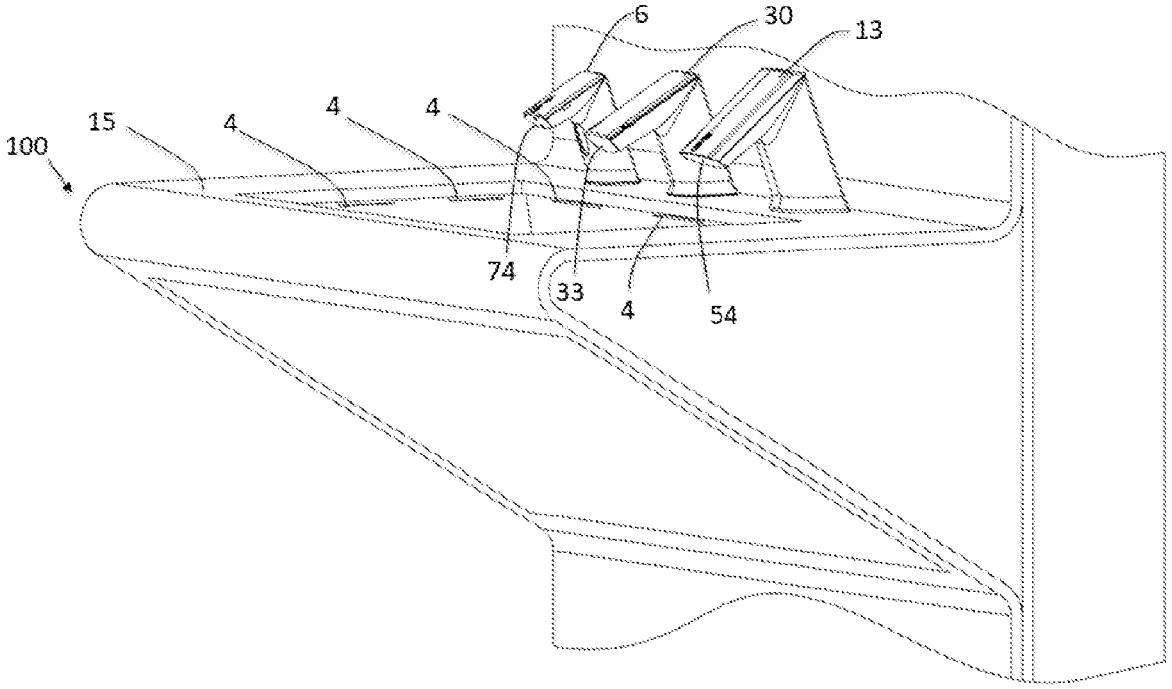
FIG. 6 shows a portion of the sink system having the recirculating air system of FIG. 5.

In one embodiment, the sink system 100 includes an air recirculation system 102. As described in greater detail below, the air recirculation system 102 includes one or more components configured to facilitate, alter, and/or change air from the sink basin region 16 through a plenum cavity 17 to be subsequently used by the hand dryer 13. In some embodiments, the recycled air travels outside of the sink system 100 into the ambient restroom space. As shown in FIG. 5, the sink system 100 includes (or is operably connected to a structure that includes) a mirror and mirror lighting system 8. The sink system 100 may include one or more access panels 7 that are configured to give a user access to one or more components or features of the sink system 100. The access panels 7 may be latchable and detachable from a structure of the sink system 100 or surrounding bathroom and/or wall fixtures. For example, the access panel may provide access to the plenum cavity 17. Accordingly, the plenum cavity 17 may be formed between the sink basin 16 and the access panels 7 disposed in the outer shell 20. The sink system 100 includes the plurality of air intake vents 4 around the sink basin 16 (e.g., upper portion of the sink basin region 16*a*) and a soap dispenser 6, faucet 30, and dryer 13 along the sink deck 15. The faucet 30 includes a nozzle(s) 33 which serves as the exit point from the faucet 30 for the water, dispensing the water into the basin region 16*a*. The dryer 13 includes an exhaust 54 which serves to blow out high velocity air 14 out of the exhaust 54 onto a user's wet hands blowing off the water while the hands are still within the sink basin region 16*a*. The soap dispenser 6 includes a nozzle(s) 74 which serves as the exit point from the soap dispenser 6 for the soap (e.g., cleansing and/or lubricating product), dispensing the soap into the basin region 16*a*.

Figure 11A:
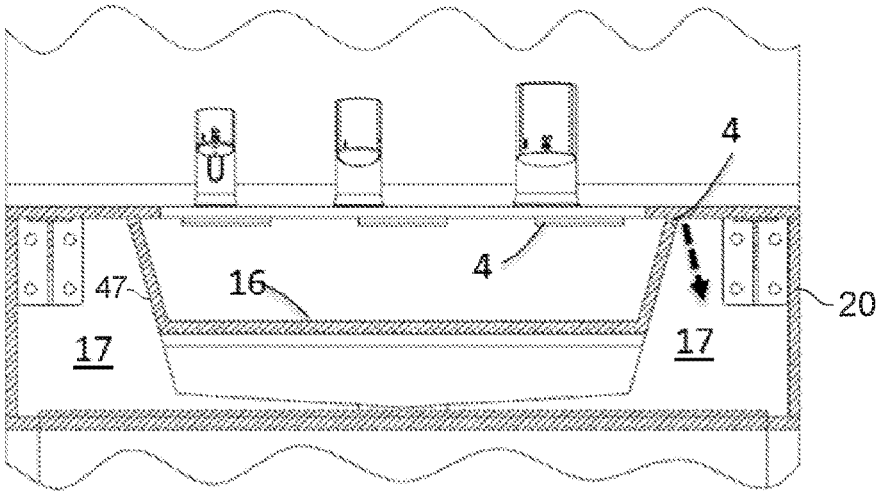
FIG. 11A shows a cross-sectional view of the front of the sink system of FIG. 6.
Figure 11B:
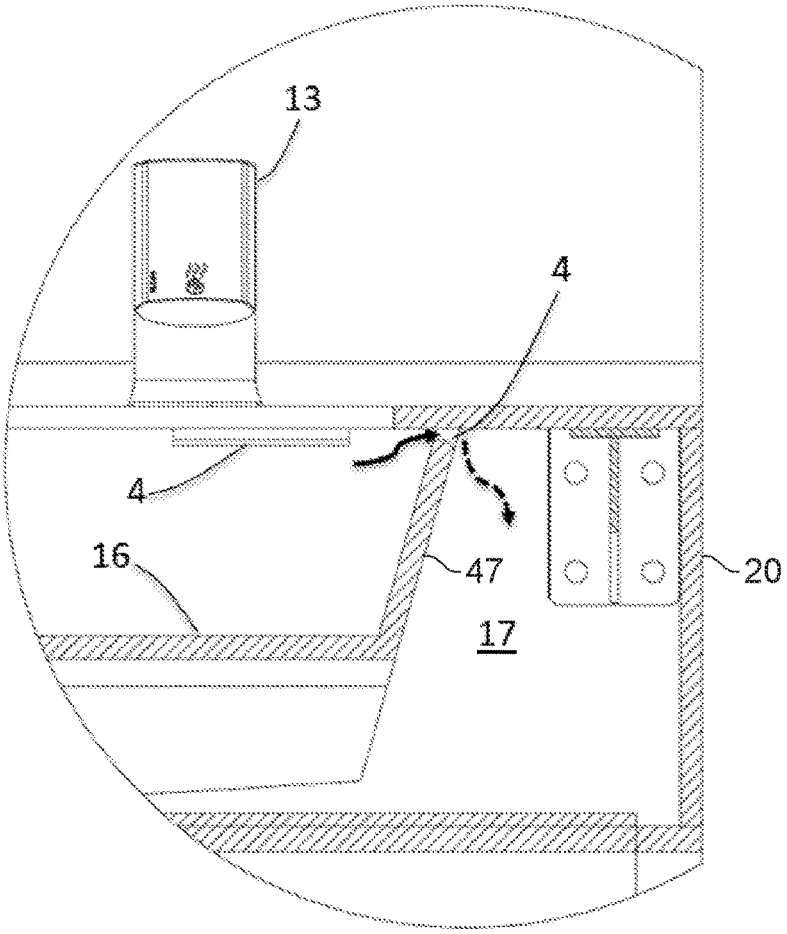
FIG. 11B shows a cross-sectional view of a portion of the front of the sink system of FIG. 11A.

Turning to FIGS. 11A and 11B, cross-sectional views of the front of the sink system 100 is shown. Generally, the plurality of air intake vents 4 are inlets into the top portion of the plenum cavity 17 allowing air to flow from the sink basin 16 through an intake vent 4 and into the plenum cavity 17 formed between a plenum region 47, such as a portion of the sink basin 16, and an outer shell 20. The plenum region 47 being an internal (e.g., not exposed to the user) portion of the sink basin 16, such as a bottom surface of the sink basin 16. In some embodiments, the plurality of air intake vents 4 are intakes from the top portion of the sink basin 16, particularly in implementations where residual air does not get diverted into the plenum cavity 17. In some embodiments, negative air pressure in the plenum cavity 17 caused by the operation of a fan, for example the exhaust fan 25, may cause air to flow through one of the plurality of air intake vents 4.

Figure 7:
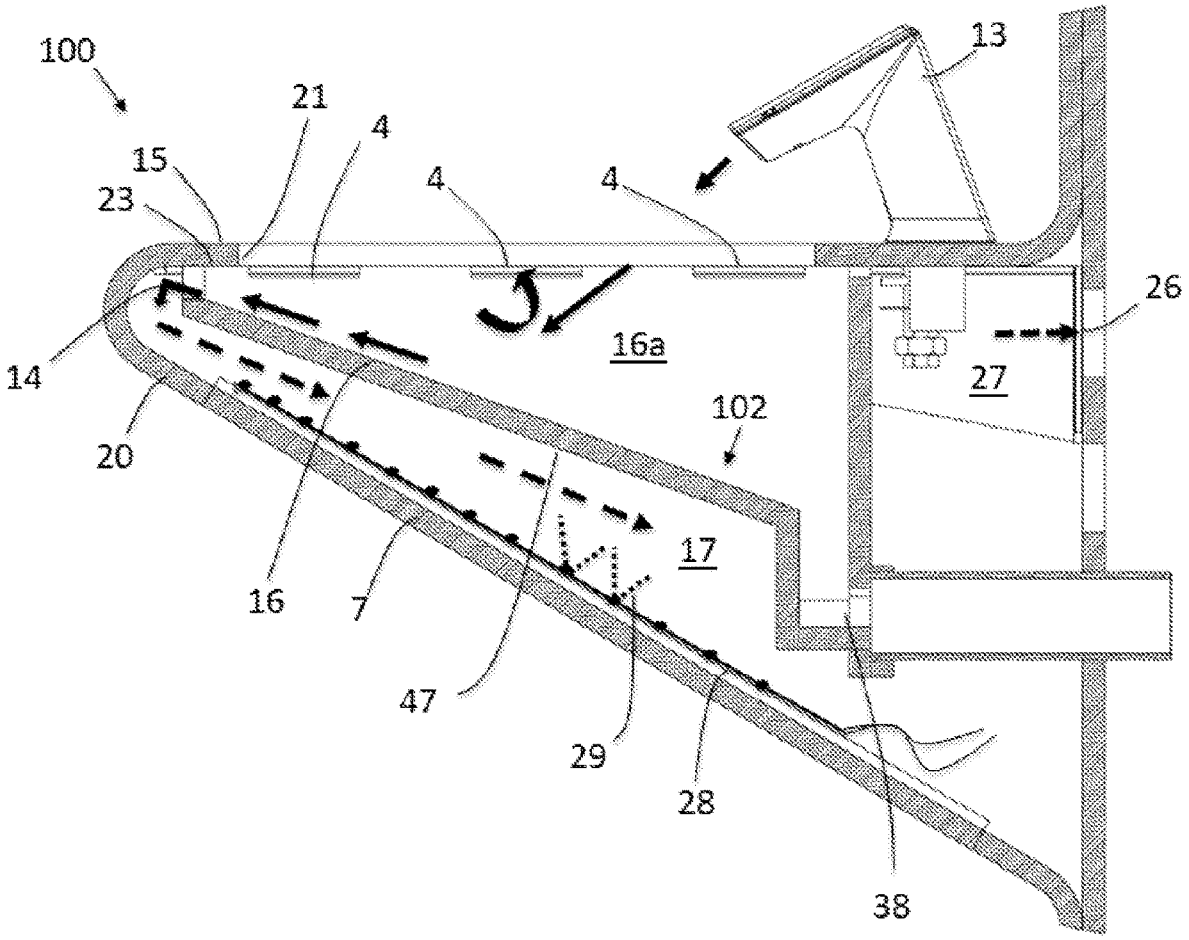
FIG. 7 shows a cross-sectional view of the sink system of FIG. 6.

Referring to FIG. 7, the sink system 100 includes an integrated sink and back wall washing system that includes an air recirculation system 102 with a plenum region 47 that forms a plenum cavity 17 (e.g., plenum area). The air recirculation system 102 with a plenum area (e.g., cavity) takes advantage of the flexibility of the composite fabrication of the solid surface sink deck 15 by integrating the plumbing side of the sink with a novel plenum cavity 17 that recycles and reconditions the air. The recycled and recondition air is used by hand dryer 13 to complete a hand washing regime during the final hand drying element. As used herein, the term "final hand drying" refers to the last step in the hand washing regime that includes drying the user's hands. In some embodiments, air in the plenum cavity 17 is expelled outside of the sink system 100 (e.g., into the restroom air space) and subsequently sucked back into the sink system 100 by entering a forced air line 12 that is connected to an outlet of the blower motor 10. In that way, the sink system 100 recycles the air to the hand dryer 13. In some implementations, the air stored in the plenum cavity 17 is recycled to the hand dryer 13 by subsequently entering a forced air line 12 that is connected to an outlet of the blower motor 10.

In some embodiments, the sink system 100 implements an integrated sink such that all liquids are acquired (e.g., in contact with the user's hands) above the sink basin 16 and all the liquids are dried from the hands within an area close to, identical to, or adjacent to the location where the liquids are acquired such that the final element of drying the user's hands off of all liquids occurs within a small sphere (e.g., a small sphere of movement, a small range of movement, etc.). In some embodiments, the sink system 100 also takes advantage of the moving air mass introduced into a commercial restroom by introducing a "scent convenience" in the form of fragrance introduced into the restroom air space. In some embodiments, the introduction of the fragrance into the restroom air space may be done through reverse flow of air mass in conjunction with an air diffuser.

As shown in FIG. 7, the plenum cavity 17 is formed between the sink basin 16 and the outer shell 20 (e.g., outer wall). Specifically, the plenum cavity 17 is formed by an internal surface (e.g., not in contact with the user, hidden from the user, etc.) of the sink basin 16, referred to herein as the plenum region 47, and an internal surface of the outer shell 20. In some embodiments, the plenum region 47 is similar to and/or formed by the sink basin 16. The outer shell 20 forms an outer sink structure (e.g., the structure visible to the user, the area the user is adjacent to when using the sink system 100, etc.) and the plenum region 47 has an interrupted upper surface that form air intake vents 4 at various locations along the upper sealing surface. With a series of air intake vents 4 around the circumference of the basin 16, air streams 14 are forced out of the basin area 16*a* into the plenum cavity 17 below the sink basin 16. In some embodiments, the air intake vents are formed at various locations at 360-degrees around the upper sealing surface.

The plenum region 47 forms the plenum cavity 17 of return air and on the opposite side forms the sink drain 38 area of the sink system 100. For example, as seen in FIG. 7, the basin 16 separates the basin area 16*a*, which is exposed to the user and configured to receive water, soap, and forced air, from the plenum cavity 17, which is configured to receive air. In some implementations, the air received by the plenum cavity 17 may carry water and soap, from the basin area 16*a*, particularly after passing over a user's hands during a handwash cycle. In one embodiment, the plenum cavity 17 is defined by an outer shell 20 that is adjacent to the bottom of the sink, with the plenum cavity 17 defined between this shell 20 and the sink basin 16, where the outer shell 20 continues from the sink deck extending downward encompassing the sink basin 16 from the underside. The outer shell 20 may define the under-sink region outside of the sink system 100. The sink system 100 closes the air path used in final hand drying element until it can be directed onto the critical hand drying function with minimal blow back onto user or into proximate air space. In other words, the plenum region 47 and outer shell 20 may form a "closed plenum" that stores the used air and/or air path until it can be directed onto the critical hand drying function with minimal blow back onto user or into proximate air space. In those embodiments, the air stored in the plenum cavity 17 is recycled to the hand dryer 13 through an upper deck area that is in fluid communication with the hand dryer 13. In those embodiments, a motor or fan may be implemented to drive the air from the plenum cavity 17, through the upper deck area, and to the hand dryer 13.

Figure 8:
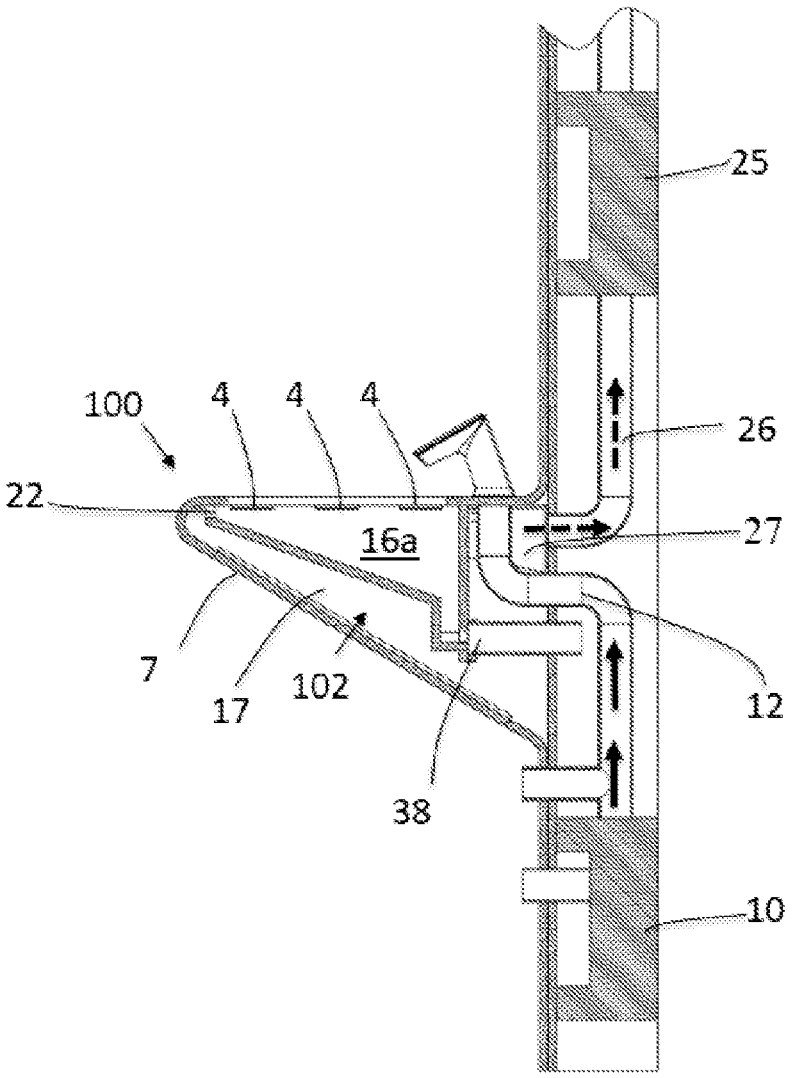
FIG. 8 shows a cross-sectional view of the sink system and vanity of FIG. 6.

In one embodiment, an exhaust flow system is provided within the sink system 100 that drives air from the plenum cavity 17, creating negative air pressure at the exhaust unit or opening(s). For example, as shown in FIG. 8, an exhaust fan 25 is operably connected to an upper deck area 27 to receive return air flow 26. In other embodiments, the exhaust flow system may be implemented at the vent lip 21, along the plenum cavity 17, at an upper deck area 27, or at a wide variety of locations along the flow path between the vent lip 21 and the upper deck area 27.

Exhausting of air from the plenum cavity 17 is achieved in order to better supply a lower pressure zone and more efficiently direct the hand dryer air streams 14 to the outlet plenum cavity 17. In some embodiments, a supplemental high efficiency exhaust fan that is configured to provide a negative pressure inner cavity under the sink deck 15 downstream from the intake vent 4. The supplemental high efficiency exhaust fan 25 may be 160 cfs and implemented along the air flow path between the catching edge 23 and the upper deck area 27. In some implementations, the supplemental high efficiency exhaust fan 25 is connected to an electronic control so that its operation is synchronized to the primary hand dryer 13 blower operation.

In some embodiments, the air recirculation system 102 and plenum region 47 can also be supplemented by a digital reversing suction motor (e.g., bathroom exhaust fan 25) so as to create a suction within the below deck sink plenum cavity 17 and assist in channeling the hand drying forced air streams 14 into the plenum cavity 17, assisting in creating an even lower pressure zone to more completely exhaust the hand drying forced air streams 14 and saturated water/air moisture.

With the return air flow 26 coming from the upper deck are 27—as the air recirculation system 102 includes a substantially sealed plenum cavity 17 (e.g., minimal new outside air—there is enough venting opportunity to mitigate any adverse motor operation. In one embodiment, the return air vents 4 located offset, such as ¾", behind an upper edge of the sink basin act as lip (or catching edge) so as to minimize repeated moisture into the plenum cavity 17 which might be problematic to long term operation.

Since a reasonably confined plenum cavity 17 is defined by this sink system, the passing air through the plenum cavity 17 can be further processed using UV technology. In some embodiments, the air recirculation system 102 includes a UV LED light 28 that radiates UV light 29 within the plenum cavity 17. The UV light 29 may be UV or UVc LED lights 28 that can be used to further clean the air passing through the plenum cavity 17 by radiating UV 29 onto the air passing through the plenum into the air inlets to the supplemental high efficiency exhaust fan 25 or used again alternatively by the hand dryer blower inlet which might extract inlet air to the dryer via the plenum. In some embodiments, an additional air purifier or air purifying element may be implemented along the air flow path in the plenum cavity 17 to purify the air. The air purifying element may be an ozone emitting purifier may also allow for the passing air to be treated by ozone emission into the air passing through the plenum cavity 17.

Figure 10:
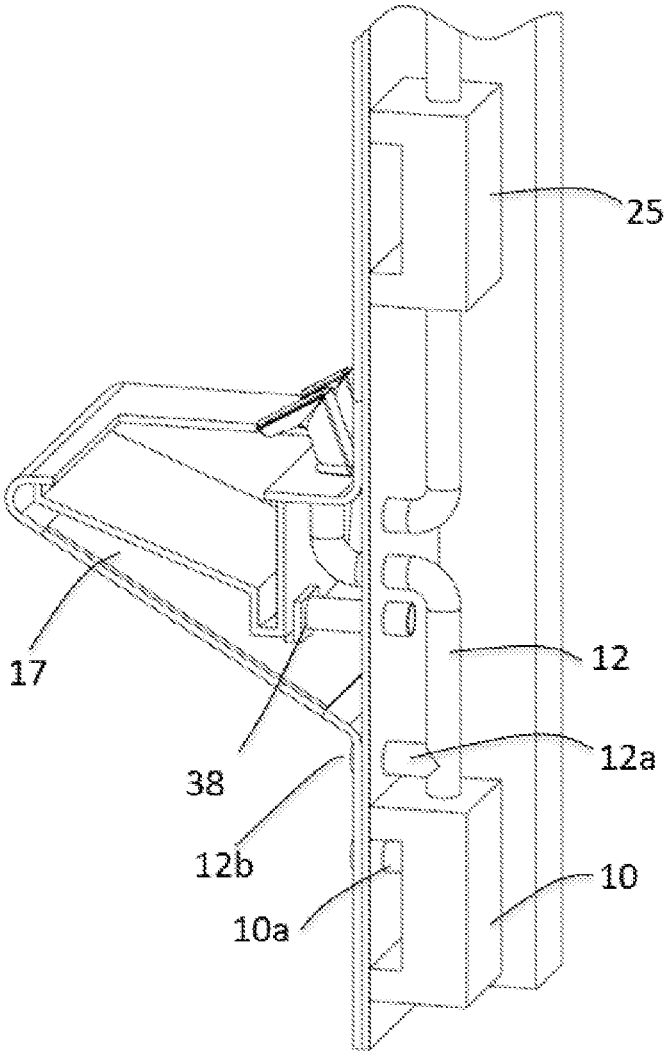
FIG. 10 shows a cross-sectional view of a sink system with a fragrance diffuser in a second location, according to another example embodiment.

In some embodiments, and as shown in FIG. 10, the air intake from the ambient restroom space into the hand dryer motor can also include a "HEPA" (High efficiency particulate arrestance) filter 10*a* to maintain reasonably comfortable air deflected back into the restroom space. The HEPA filter 10*a* may be disposed between the ambient restroom space (e.g., outside the sink system 100) and the forced air line 12. In other embodiments, a closed plenum cavity 17 is configured to optimize the amount of deflected air that is reused and filtered with this HEPA consumable filter 10*a*. The HEPA filter 10*a* may be disposed between the plenum cavity 17 and the forced air line 12. In some implementations, the forced air line 12 is connected to the outlet of the blower motor 10 such that a fragrance diffuser 12*a* is incorporated and configured to allow passing hand drying air to be fragranced. As used herein, the term "fragrance diffuser" refers to a device or substance that provides a scent, fragrance, or substance that is structured to alter the scent of the ambient air in the bathroom and/or around the sink system. The fragrance diffuser may be a passive device, such that air flowing by the diffuser is in contact with and mixes with the fragrance, or active, such that air diffuser doses (e.g., sprays) the fragrance into the air flow during intervals or under certain conditions.

Figure 9:
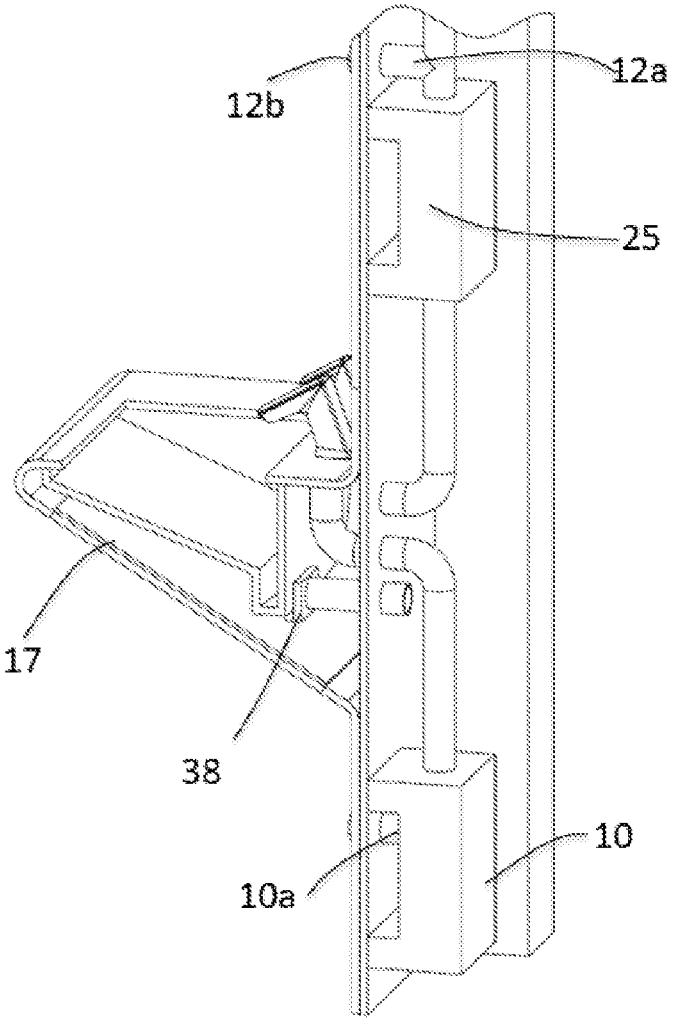
FIG. 9 shows a cross-sectional view of a sink system with a fragrance diffuser in a first location, according to an example embodiment.

The fragrance diffuser 12*a* may be assembled in line with the forced air line 12 and configured to receive a suitable fragrance bar insert or other fragrance capsule (e.g., holding device) in a fragrance diffuser cavity 12*b*. The sink system 100 is configured such that the fragrance diffuser 12*a* is serviceable by opening an access panel 7 to access the fragrance diffuser cavity 12*b* to replenish the fragrance bar. In some embodiments, suitable programming logic on the blower 10 motor will allow for auto start of the motor under minimal operational conditions in order to allow for fragrance from the fragrance diffuser 12*a* to propagate into the sink cavity and surrounding room air. As shown in FIG. 9, in some embodiments, the fragrance diffuser 12*a* is disposed between the air line 12 and the exhaust fan 25. As shown in FIG. 10, the fragrance diffuser 12*a* is disposed between the air line 12 and the outside ambient restroom air. In other embodiments, however, the fragrance diffuser 12*a* is disposed between the air line 12 and the plenum cavity 17 or between the plenum cavity 17 and an outlet of the sink system 100.

The sink system 100 can be of a singular construction, such that the sink system 100 and one or more of its components are integrated into the sink fabrication and back wall facia. As used herein, the term "back wall facia" includes mirror, light(s) 8, and LED accent lighting. In some embodiments, the sink system 100 includes one or more convenient access panels to the below deck plumbing to facilitate maintenance (e.g., cleaning, fixing, replenishment, servicing, etc.) of the HEPA filter 10*a*, soap, UV LED lighting 28, fragrance diffuser 12*a*, or other components.

The mirror and mirror lighting system may include one or more LED accent lighting. In some embodiments, the LED accent lighting may include Ultraviolet lighting in the plenum cavity 17, that will "glow" purple through the air intake vents 4 in the upper rim air return plenum as a user faces down into the sink basin. Alternatively, the undermount sink 18 can be of a translucent material such as ⅜" safety glass with U.V. protection allowing the plenum area U.V. lighting to illuminate the sink bottom. This can also be accomplished with LED accent lighting added to the below deck plenum cavity.

In some embodiments, electronic controls for the sink system 100 allow for sequenced operation of the electronic devices and aesthetic LED lighting as well as maintenance reminders for consumables such as soap and HEPA filters. Short range communication can also enhance the lavatory sink panel to broadcast soft maintenance alarms or broadcast through visible maintenance devices, (such as pulsating light sequences) so as to draw attention to a discrete sink panel needing some service, emergency or routine.

In some embodiments, the supplemental exhaust fan 25 may be able to reverse its rotation and exhaust, as opposed to suction, into the plenum cavity 17. This feature of reversing flow could assist in expelling more completely into the restroom space fragranced air supplied by the fragrance diffuser in the alternative location of the fragrance diffuser in the supplemental exhaust fan air inlet, for example, as shown in FIG. 9. This action would be controlled by controller logic so as to only be performed based upon (e.g., associated with) restroom activity. A fragrance dispenser can further be associated with the plenum region 47 and/or plenum cavity 17 to provide a source of fragrance, such as aerosol, vapor, or gas (not shown).

In one embodiment, the plenum cavity 17 may be in communication with a water line and or a water reservoir. The communication may include a heat exchanger, such as a high surface area interface. The air from the dryer that exhausts through the opening into the plenum can then transfer thermal energy to the water in the water line as it passes in the automatic faucet 13.

As used herein, the singular forms "a", "an" and "the" include plural referents unless the context clearly dictates otherwise. Thus, for example, the term "a member" is intended to mean a single member or a combination of members, "a material" is intended to mean one or more materials, or a combination thereof. As used herein, the terms "about" and "approximately" generally mean plus or minus 10% of the stated value. For example, about 0.5 would include 0.45 and 0.55, about 10 would include 9 to 11, about 1000 would include 900 to 1100.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Other substitutions, modifications, changes and omissions may also be made in the design, operating conditions and arrangement of the various exemplary embodiments without departing from the scope of the present invention.

While this specification contains many specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

We claim:

1. A drying system comprising an outer shell defining a sink deck;

a sink basin disposed within the outer shell, the sink basin defining a sink basin region and a plenum region, the plenum region separated from the sink basin region by a vent ring, the sink deck being separated from the sink basin region of the sink basin by the vent ring, a plenum cavity formed between an internal surface of the outer shell and the plenum region;

the vent ring having a vent with an associated opening, the opening exposed to the sink basin region and to an area underneath the sink deck, the opening allowing a flow of air therethrough; and a dryer configured to direct forced air through a dryer exhaust port into the sink basin region of the sink basin, the dryer is positioned relative to the sink basin region and the vent such that the forced air from the dryer is directed through the dryer exhaust port into the sink basin region and then into vent.

2. The drying system of claim 1, further comprising a plurality of intake vents, each intake vent in the plurality of intake vents formed in a top portion of the sink basin adjacent to the sink deck of the outer shell, each intake vent in the plurality of intake vents placing the sink basin region in fluid communication with the plenum cavity.

3. The drying system of claim 2, further comprising a fan configured to generate a low pressure vacuum in the plenum cavity, wherein the low pressure vacuum is positioned such that air blown through the dryer exhaust port into the sink basin region is drawn into the plenum cavity through at least one intake vent in the plurality of intake vents, the fan in fluid communication with the plenum cavity.

4. The drying system of claim 3, wherein the fan is in fluid connection with an outside of the drying system, the fan configured to cause a first portion of the air from the plenum cavity to exit the drying system, wherein a second portion of the air flows back through the dryer exhaust port, the air having been previously blown through the dryer exhaust port into the sink basin region.

5. The drying system of claim 1, further comprising a ultraviolet light system disposed on the internal surface of the outer shell, the ultraviolet light system configured to purify air in the plenum cavity with an ultraviolet light.

6. The drying system of claim 1, further comprising a ultraviolet light system disposed on the plenum region, the ultraviolet light system configured to purify air in the plenum cavity with an ultraviolet light.

7. The drying system of claim 1, further comprising a forced air line disposed between the plenum cavity and the dryer exhaust port, the forced air line configured to force air from the plenum cavity through the forced air line to the dryer exhaust port.

8. The drying system of claim 7, further comprising a hand dryer blower motor disposed between the forced air line and the plenum cavity, the hand dryer blower motor comprising an air intake configured to receive air from the plenum cavity, the air having been previously blown through the dryer exhaust port into the sink basin region.

9. The drying system of claim 8, further comprising a HEPA filter positioned between the plenum cavity and the forced air line, the HEPA filter configured to remove particulates from the air passing into the air intake of the hand dryer blower motor.

10. The drying system of claim 8, further comprising a controller with a logic system, the logic system configured to allow for auto start of the hand dryer blower motor under minimal operational conditions in order to allow for a fragrance to propagate into the sink basin region and surrounding air.

11. The drying system of claim 7, a fragrance diffuser disposed along the forced air line, the fragrance diffuser configured to introduce a substance into the air passing through the forced air line, the substance altering a scent of the air.

12. The drying system of claim 11, further comprising a controller with a logic system, the logic system configured to introduce the substance into the air at an interval.

13. The drying system of claim 11, further comprising a controller with a logic system, the logic system configured to alert a user of the substance running low.

14. The drying system of claim 1, further comprising an exhaust fan disposed above the sink basin, the exhaust fan in fluid communication of the plenum cavity and an outside of the drying system, the exhaust fan configured to draw air flow from the plenum cavity through the exhaust fan and out of the drying system.

15. A sink system comprising:

a sink deck having a sink opening and an outer shell, the sink deck being separated from a sink basin region of a sink basin by a vent ring, a sink basin disposed within the outer shell, the sink basin defining a sink basin region and a plenum region, the plenum region separated from the sink basin region by the vent ring, a plenum cavity formed between an internal surface of the outer shell and the plenum region;

the vent ring having a vent with an associated opening, the opening exposed to the sink basin region and to an area underneath the sink deck, the opening allowing a flow of air therethrough; and a dryer configured to direct forced air through a dryer exhaust port into the sink basin region of the sink basin, the dryer is positioned relative to the sink basin region and the vent such that the forced air from the dryer is directed through the dryer exhaust port into the sink basin region and then into vent.

16. The sink system of claim 15, wherein a portion of the sink deck forms a lip defining the sink opening and extending into the sink basin region, further comprising a plurality of intake vents, each intake vent in the plurality of intake vents formed in a top portion of the sink basin adjacent to the lip, each intake vent in the plurality of intake vents placing the sink basin region in fluid communication with the plenum cavity.

17. The sink system of claim 16, further comprising a fan configured to generate a low pressure vacuum in the plenum cavity, wherein the low pressure vacuum is positioned such that air blown through the dryer exhaust port into the sink basin region is drawn into the plenum cavity through at least one intake vent in the plurality of intake vents, the fan in fluid communication with the plenum cavity.

18. The sink system of claim 17, wherein the fan is in fluid connection with an outside of the sink system, the fan configured to cause a first portion of the air from the plenum cavity to exit the sink system, wherein a second portion of the air flows back through the dryer exhaust port, the air having been previously blown through the dryer exhaust port into the sink basin region.

19. The sink system of claim 15, further comprising an ultraviolet light system disposed in the plenum cavity, the ultraviolet light system configured to purify air in the plenum cavity with an ultraviolet light.

20. The sink system of claim 15, further comprising:

a forced air line disposed between the plenum cavity and the dryer exhaust port, the forced air line configured to force air from the plenum cavity through the forced air line to the dryer exhaust port;

a hand dryer blower motor disposed between the forced air line and the plenum cavity, the hand dryer blower motor comprising an air intake configured to receive air from the plenum cavity, the air having been previously blown through the dryer exhaust port into the sink basin region;

a HEPA filter positioned between the plenum cavity and the forced air line, the HEPA filter configured to remove particulates from the air passing into the air intake of the hand dryer blower motor.

* * * * *